US012369700B2

(12) United States Patent
Dai et al.

(10) Patent No.: US 12,369,700 B2
(45) Date of Patent: Jul. 29, 2025

(54) PACKAGING TUBE AND MECHANISM CORE THEREOF

(71) Applicant: ALBEA PLASTIC METALLIZING TECHNOLOGIES (SHANGHAI) CO., LTD., Shanghai (CN)

(72) Inventors: Burning Dai, Shanghai (CN); Xin Yang, Shanghai (CN)

(73) Assignee: ALBEA PLASTIC METALLIZING TECHNOLOGIES (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 18/736,299

(22) Filed: Jun. 6, 2024

(65) Prior Publication Data

US 2024/0407532 A1 Dec. 12, 2024

(30) Foreign Application Priority Data

Jun. 12, 2023 (CN) ..... 202321493778.1

(51) Int. Cl.
*A45D 40/04* (2006.01)
*A45D 40/00* (2006.01)

(52) U.S. Cl.
CPC ..... *A45D 40/04* (2013.01); *A45D 2040/0025* (2013.01)

(58) Field of Classification Search
CPC . A45D 40/04; A45D 40/06; A45D 2040/0025
USPC ..... 401/68, 75, 175
See application file for complete search history.

(56) References Cited

U.S. PATENT DOCUMENTS 6,200,047 B1 * 3/2001 Holloway ..... A45D 40/04 401/86
6,231,254 B1 * 5/2001 Holloway ..... A45D 40/04 401/86
11,779,095 B2 * 10/2023 Byeon ..... A45D 40/06 401/108

* cited by examiner

*Primary Examiner* — Jennifer C Chiang
(74) *Attorney, Agent, or Firm* — Kilpatrick Townsend & Stockton LLP

(57) ABSTRACT

A mechanism core includes a cup-shaped member, a driving member, and a sleeve. The cup-shaped member is configured to accommodate rod-shaped material. The sleeve is sleeved on the driving member and is rotatable relative to the driving member, and the cup-shaped member is movable in an axial direction when the sleeve rotates relative to the driving member. An annular flange is formed on a radial inner surface of the sleeve, and the annular flange is configured to contact a radial outer surface of the driving member facing the sleeve, so that the annular flange is slidable relative to the radial outer surface of the driving member during rotation of the sleeve relative to the driving member. The mechanism core reduces a contact area of the sleeve and the driving member is reduced, and a friction force between the sleeve and the driving member during rotation.

8 Claims, 13 Drawing Sheets

PACKAGING TUBE AND MECHANISM CORE THEREOF

CROSS-REFERENCE TO RELATED APPLICATIONS

This application claims priority to Chinese Application No. 202321493778.1, filed Jun. 12, 2023, the contents of which are incorporated herein by reference in their entirety.

TECHNICAL FIELD

The application relates to the technical field of packaging cosmetics, and more particularly, to a packaging tube and a mechanism core thereof.

BACKGROUND

A packaging tube for rod-shaped material (such as a lipstick tube, etc.) generally consists of a top cover, a base, and a mechanism core. The top cover and the base form a cavity surrounding the mechanism core together. The mechanism core includes a cup-shaped member configured to accommodate the rod-shaped material, and a driving member configured to drive the cup-shaped member to move in an axial direction by way of rotation. In the related art, when the cup-shaped member is driven to move in the axial direction by way of rotation, a jamming situation thereof easily occurs, which affects user experience.

SUMMARY

In view of the above technical problem, the application provides a packaging tube and a mechanism core thereof, which may reduce the jamming situation when the cup-shaped member is driven to move in the axial direction by way of rotation.

According to a first aspect of the application, the application provides a mechanism core, the mechanism core includes a cup-shaped member, a driving member, and a sleeve. The cup-shaped member is configured to accommodate rod-shaped material. The sleeve is sleeved on the driving member and is rotatable relative to the driving member, and the cup-shaped member is movable in an axial direction when the sleeve rotates relative to the driving member. At least one annular flange is formed on a radial inner surface of the sleeve, and the at least one annular flange is configured to contact a radial outer surface of the driving member facing the sleeve, so that the at least one annular flange is slidable relative to the radial outer surface of the driving member during rotation of the sleeve relative to the driving member.

Further, a surface of the annular flange facing the driving member may be a smoothly-transitioned curved surface which is high at center and low at two ends.

Further, lubricating oil may be filled between the radial inner surface of the sleeve and the radial outer surface of the driving member facing the sleeve.

Further, there may be two annular flanges in number, and the two annular flanges are formed on the radial inner surface of the sleeve at an interval in the axial direction, to seal the lubricating oil between the two annular flanges.

Further, the radial inner surface of the sleeve may extend obliquely outward from top to bottom, and correspondingly, the radial outer surface of the driving member facing the sleeve extends obliquely outward from top to bottom.

Further, the driving member may be provided with an internal channel, and a radial inner wall of the internal channel is provided with a spiral guide groove extending in the axial direction. The mechanism core further includes a rod extending downward from bottom of the cup-shaped member into the internal channel of the driving member, at least a part of the rod is provided with an external thread adapted to the spiral guide groove. The rod is hollow at interior thereof.

Further, the rod may be formed with a channel penetrating it in the axial direction, at the interior thereof.

Further, the mechanism core may further include a bushing. The bushing extends around the cup-shaped member in the axial direction and is connected to the sleeve, and the cup-shaped member is movable inside the bushing in the axial direction when the sleeve rotates relative to the driving member. The bushing and the sleeve form an integrally molded member, or the bushing is connected to the sleeve by plugging-in.

Further, an annular limiting groove may be formed on the radial inner surface of the sleeve, an annular limiting protrusion is formed on the radial outer surface of the driving member, and axial positioning of the sleeve and the driving member is achieved through cooperation of the annular limiting groove and the annular limiting protrusion. The at least one annular flange is closer to the cup-shaped member than the annular limiting groove.

According to a second aspect of the application, the application provides a packaging tube, the packaging tube includes a base, a mechanism core according to the first aspect of the application, and a cover. The mechanism core is arranged on the base. The cover is configured to form, with the base, a cavity surrounding the mechanism core.

According to the packaging tube and the mechanism core of the embodiments of the application, at least one annular flange is formed on the radial inner surface of the sleeve, and the annular flange is slidable relative to the radial outer surface of the driving member during rotation of the sleeve relative to the driving member. Compared with direct sliding friction between the radial inner surface of the sleeve and the radial outer surface of the driving member, a contact area of the annular flange and the radial outer surface of the driving member is small in the embodiments of the application, which is equivalent to reducing a contact area of the sleeve and the driving member, reducing a friction force between the sleeve and the driving member during rotation, thereby greatly reducing the jamming situation when the cup-shaped member is driven to move in the axial direction by way of rotation.

Additional aspects and advantages of the application will become apparent from the following descriptions, or will be understood by practice of the application. What provided in contents of the application is only an embodiment, rather than the application itself. Effects of the contents of the application are only effects of the embodiments, rather than all the technical effects of the application.

BRIEF DESCRIPTION OF THE DRAWINGS

Other objects and advantages of the application will be apparent from the following descriptions of the application made with reference to the drawings, and may help to understand the application comprehensively. In the drawings.

Figure 1:
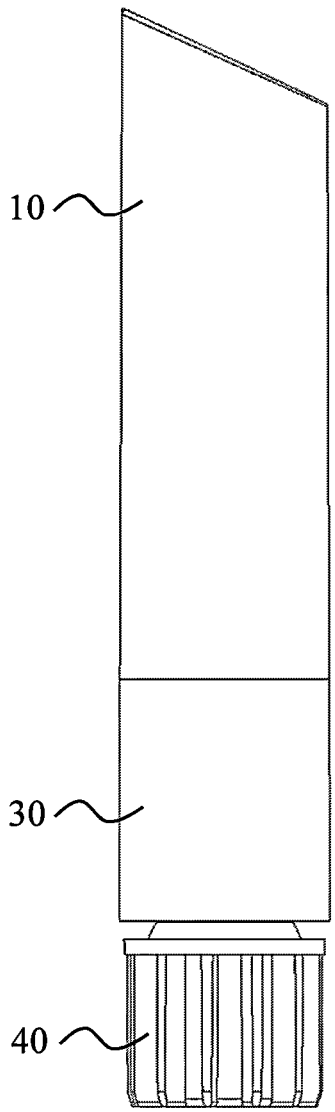
FIG. 1 is a schematic side view of a mechanism core according to an embodiment of the application.

It should be noted that the drawings are not drawn in scale, and for the purpose of explanation, elements with similar structures or functions are generally designated with similar reference numbers throughout the drawings. It should also be noted that the drawings are only intended to facilitate describing preferred embodiments, rather than the application itself. The drawings do not illustrate each aspect of the described embodiments, and do not limit the scope of the application.

EXPLANATION OF REFERENCE NUMBERS

10. bushing;

21. cup-shaped member; 22. rod; 221. external thread; 222. cut surface; 223. channel;

30. sleeve; 31. body; 32. annular limiting groove; 33. cover plate; 311. radial inner surface; 3111. first annular flange; 3112. second annular flange;

40. driving member; 400. internal channel; 401. spiral guide groove; 41. driving body; 42. annular limiting protrusion; 43. rib plate;

50. base;

60. top cover.

DETAILED DESCRIPTION

The embodiments of the application are described in detail below. Examples of the embodiments are shown in the drawings, where the same or similar reference numbers always indicate the same or similar elements or elements with the same or similar functions. The embodiments described below with reference to the drawings are exemplary, and are only intended to explain the application while cannot be understood as limitation of the application.

Contents disclosed below provide multiple different embodiments or examples to implement the application. In order to simplify contents disclosed in the application, components and methods of specific examples are described below. Of course, they are merely examples and are not intended to limit the application.

Figure 2:
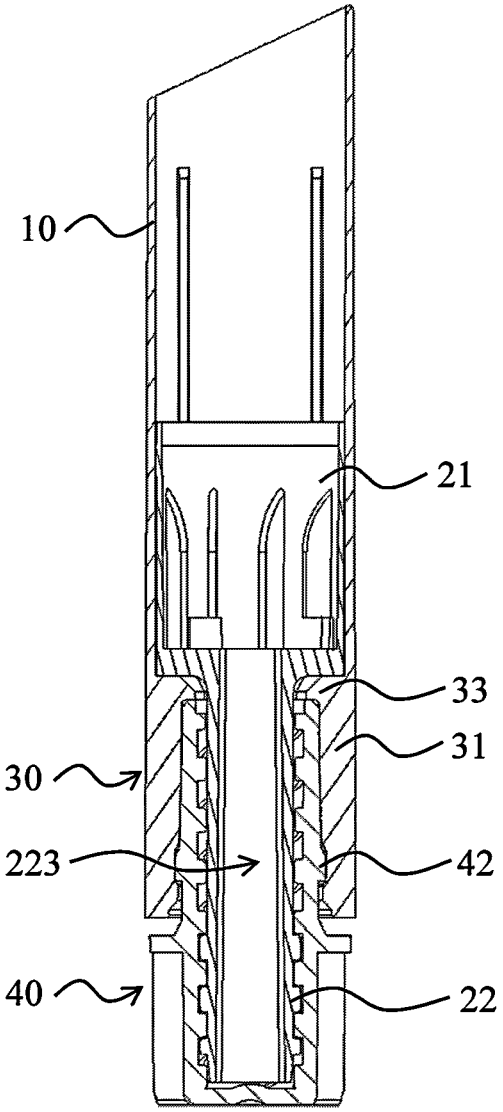
FIG. 2 is a schematic cross-sectional view of the mechanism core shown in FIG. 1, in which a cup-shaped member is in a retracted position.
Figure 3:
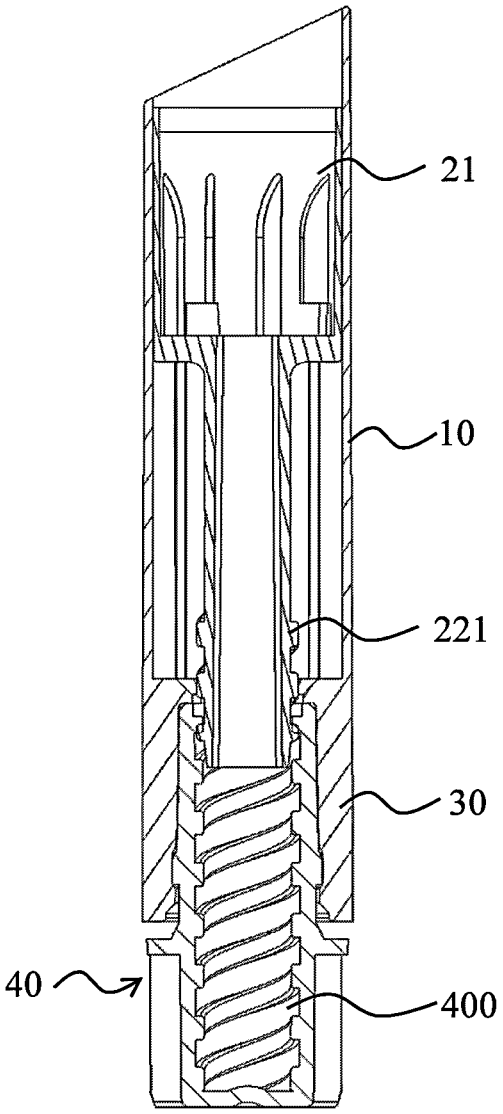
FIG. 3 is a schematic cross-sectional view of the mechanism core shown in FIG. 1, in which a cup-shaped member is in an extended position.

With reference to FIG. 1 to FIG. 3, a mechanism core of an embodiment of the application may include a cup-shaped member 21 and a driving assembly. The cup-shaped member 21 is configured to accommodate rod-shaped material. The driving assembly is configured to drive the cup-shaped member 21 to move in an axial direction, to enable the cup-shaped member 21 to move from a retracted position (see FIG. 2) to an extended position (see FIG. 3) where the rod-shaped material may be used. The driving assembly includes a sleeve 30 and a driving member 40. The sleeve 30 is sleeved on the driving member 40, and is configured to be rotatable relative to the driving member 40. The cup-shaped member 21 is movable in the axial direction when the sleeve 30 rotates relative to the driving member 40.

During rotation of the sleeve 30 relative to the driving member 40, due to limitations of production processes, it is difficult to ensure roundness of at least one of the sleeve 30, the driving member 40, a threaded guide groove 401 inside the driving member 40 mentioned later, an external thread 221 of a rod 22, or the like, so that a jamming situation may occur during relative rotation of the sleeve 30 and the driving member 40. In order to reduce the jamming situation during relative rotation of the sleeve 30 and the driving member 40, a gap between the sleeve 30 and the driving member 40 is increased in the related art. However, increase of the gap may cause the cup-shaped member to shake in a radial direction.

In view of this technical problem, with reference to FIG. 4 to FIG. 9, in the embodiments of the application, at least one annular flange is specifically formed on a radial inner surface 311 of the sleeve 30, and each annular flange may contact a radial outer surface of the driving member 40 facing the sleeve 30, so that the at least one annular flange is slidable relative to the radial outer surface of the driving member 40 during rotation of the sleeve 30 relative to the driving member 40.

According to the embodiments of the application, at least one annular flange is formed on the radial inner surface 311 of the sleeve 30, and the annular flange is slidable relative to the radial outer surface of the driving member 40 during rotation of the sleeve 30 relative to the driving member 40. Compared with direct sliding friction between the radial inner surface 311 of the sleeve 30 and the radial outer surface of the driving member 40, a contact area of the annular flange and the radial outer surface of the driving member 40 is small in the embodiments of the application, which is equivalent to reducing a contact area of the sleeve 30 and the driving member 40, reducing a friction force between the sleeve 30 and the driving member 40 during rotation, thereby greatly reducing the jamming situation when the cup-shaped member 21 is driven to move in the axial direction by way of rotation.

Furthermore, moisture content of the rod-shaped material, such as a lipstick product, contained in the cup-shaped member 21 becomes higher and higher. Moisture of the rod-shaped material becomes less and less after a user uses it for a period of time, which greatly reduces usage effect of the product. The inventor of the application found that in addition to evaporation of moisture caused by exposing the rod-shaped material to the air when the user uses it, the moisture of the rod-shaped material may also enter the sleeve 30 through the driving member 40, and then diffuse outward from a lower end opening of the sleeve 30. According to the embodiments of the application, at least one annular flange is formed on the radial inner surface 311 of the sleeve 30, which may ensure airtightness between the sleeve 30 and the driving member 40, and prevent the moisture of the rod-shaped material from diffusing outward through the lower end opening of the sleeve 30.

In some embodiments, a surface of the annular flange facing the driving member 40 is a smoothly-transitioned curved surface which is high at center and low at two ends. In such embodiments, a contact area between the annular flange and the radial outer surface of the driving member 40 may be further reduced by setting the surface of the annular flange facing the driving member 40 as the smoothly-transitioned curved surface which is high at center and low at two ends, which is beneficial to reduce the friction force between the sleeve 30 and the driving member 40.

In some embodiments, lubricating oil is filled between the radial inner surface 311 of the sleeve 30 and the radial outer surface of the driving member 40 facing the sleeve 30. Since the lubricating oil is filled between the radial inner surface 311 of the sleeve 30 and the radial outer surface of the driving member 40 facing the sleeve 30, it is beneficial to make relative rotation between the sleeve 30 and the driving member 40 smoother during rotation of the sleeve 30 relative to the driving member 40. Furthermore, according to the embodiments of the application, at least one annular flange is formed on the radial inner surface 311 of the sleeve 30, therefore the lubricating oil may be sealed by using the annular flange, to reduce loss of the lubricating oil.

In some embodiments, there are two annular flanges in number, and the two annular flanges are formed on the radial inner surface 311 of the sleeve 30 at an interval in the axial direction, to seal the lubricating oil between the two annular flanges. The two annular flanges are a first annular flange 3111 and a second annular flange 3112 respectively. When the lubricating oil is filled between the radial inner surface 311 of the sleeve 30 and the radial outer surface of the driving member 40 facing the sleeve 30, the first annular flange 3111 and the second annular flange 3112 may seal the lubricating oil inside a space there-between. In such embodiments, the first annular flange 3111, the second annular flange 3112 and the lubricating oil there-between may jointly slide relative to the driving member 40, thereby further improving feel when the sleeve 30 rotates relative to the driving member 40.

In the embodiments of the application, height of each annular flange in the radial direction is the same. The radial inner surface 311 of the sleeve 30 is relatively parallel to the radial outer surface of the driving member 40 facing the sleeve 30, so that thickness of the lubricating oil is uniformly distributed in the axial direction.

An outer diameter of the driving member 40 is slightly greater than an inner diameter of the annular flange (for example, the outer diameter of the driving member 40 is greater than the inner diameter of the annular flange by a few tenths of millimeter). After the driving member 40 is inserted into a radial inner side of the sleeve 30, the annular flange may "expand" the sleeve 30 in the radial direction, so that the sleeve 30 generates slight deformation. Correspondingly, a gap between the radial inner surface 311 of the sleeve 30 and the radial outer surface of the driving member 40 facing the sleeve 30 is the height of each annular flange in the radial direction.

In order to ensure that both the lubricating oil and the annular flange may play a role of improving the feel, the height of the annular flange in the radial direction cannot be too high, and in general, may be a few hundredths of millimeter. It is easy to understand that the height of the annular flange in the radial direction may be related to viscosity of the lubricating oil. With regard to lubricating oil with a large viscosity, the height of the annular flange in the radial direction may be slightly higher; and with regard to lubricating oil with a small viscosity, the height of the annular flange in the radial direction may be slightly lower.

Figure 4:
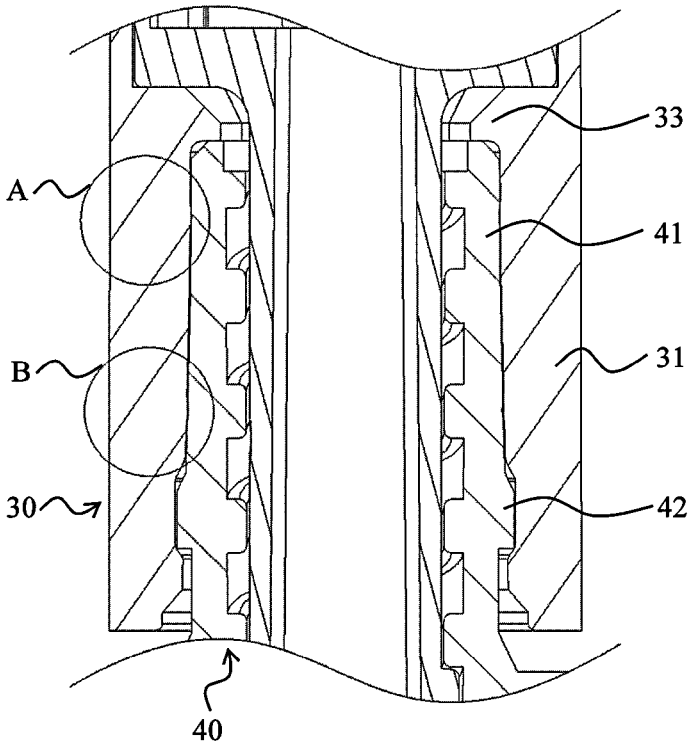
FIG. 4 is a schematic partially enlarged view of the mechanism core shown in FIG. 2.
Figure 5:
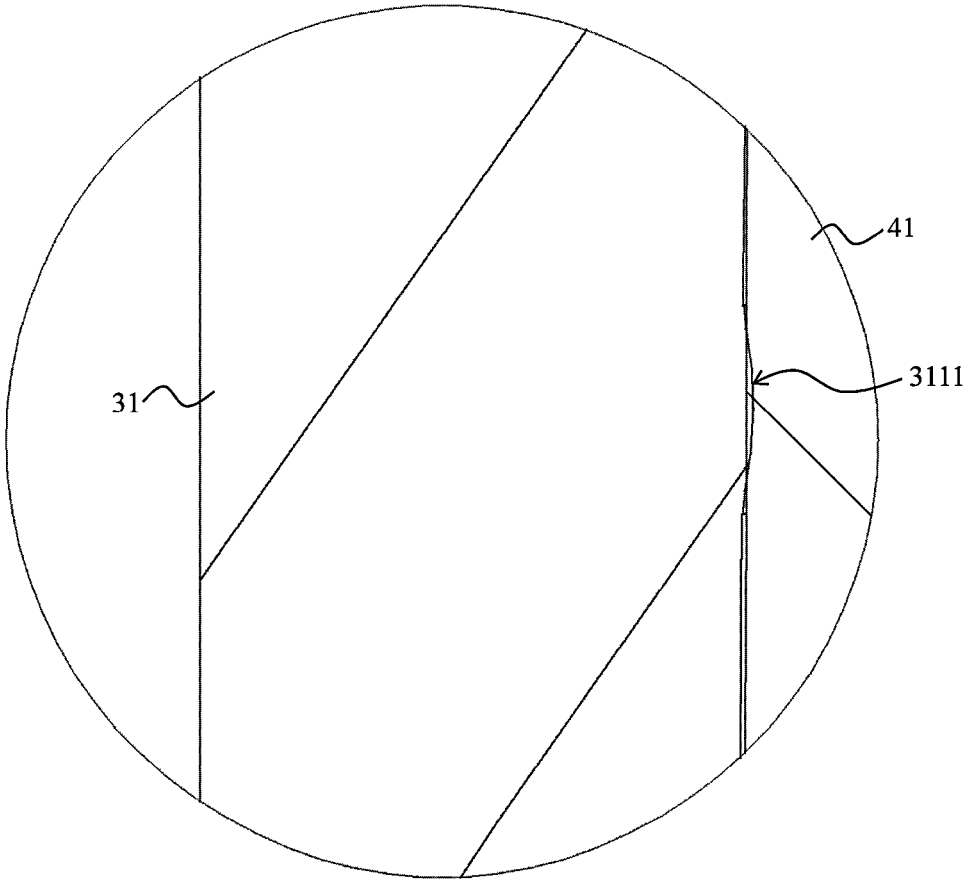
FIG. 5 is a schematic partially enlarged diagram of an area A shown in FIG. 4.
Figure 6:
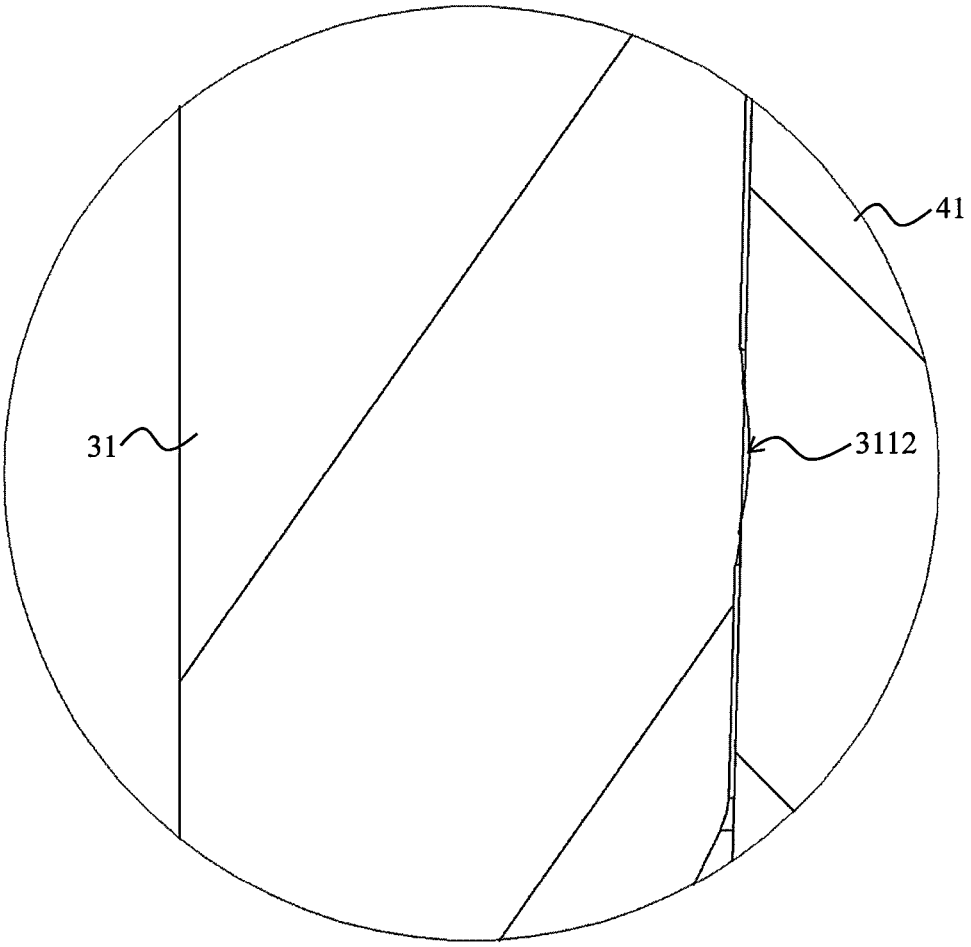
FIG. 6 is a schematic partially enlarged diagram of an area B shown in FIG. 4.
Figure 7:
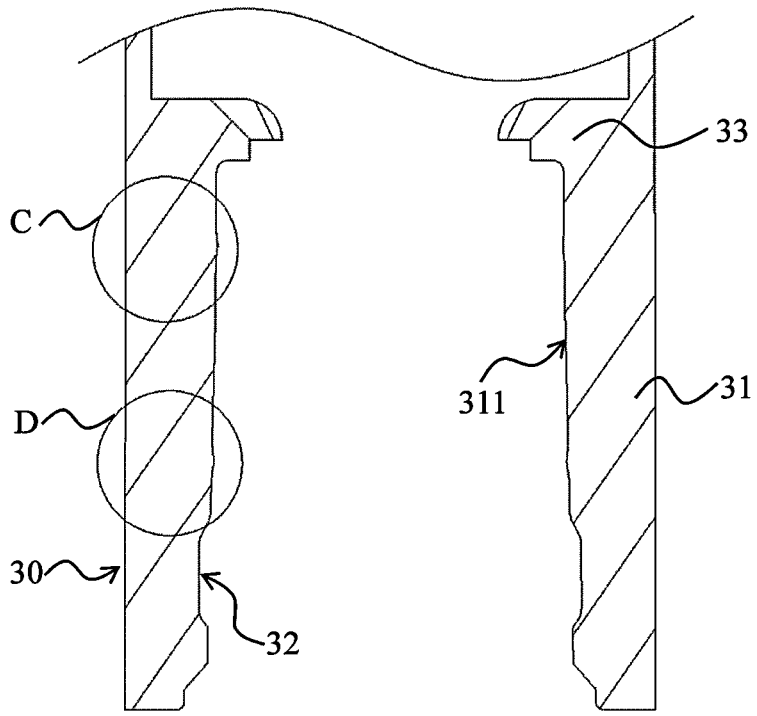
FIG. 7 is a schematic diagram of FIG. 4 from which a driving member omitted.
Figure 8:
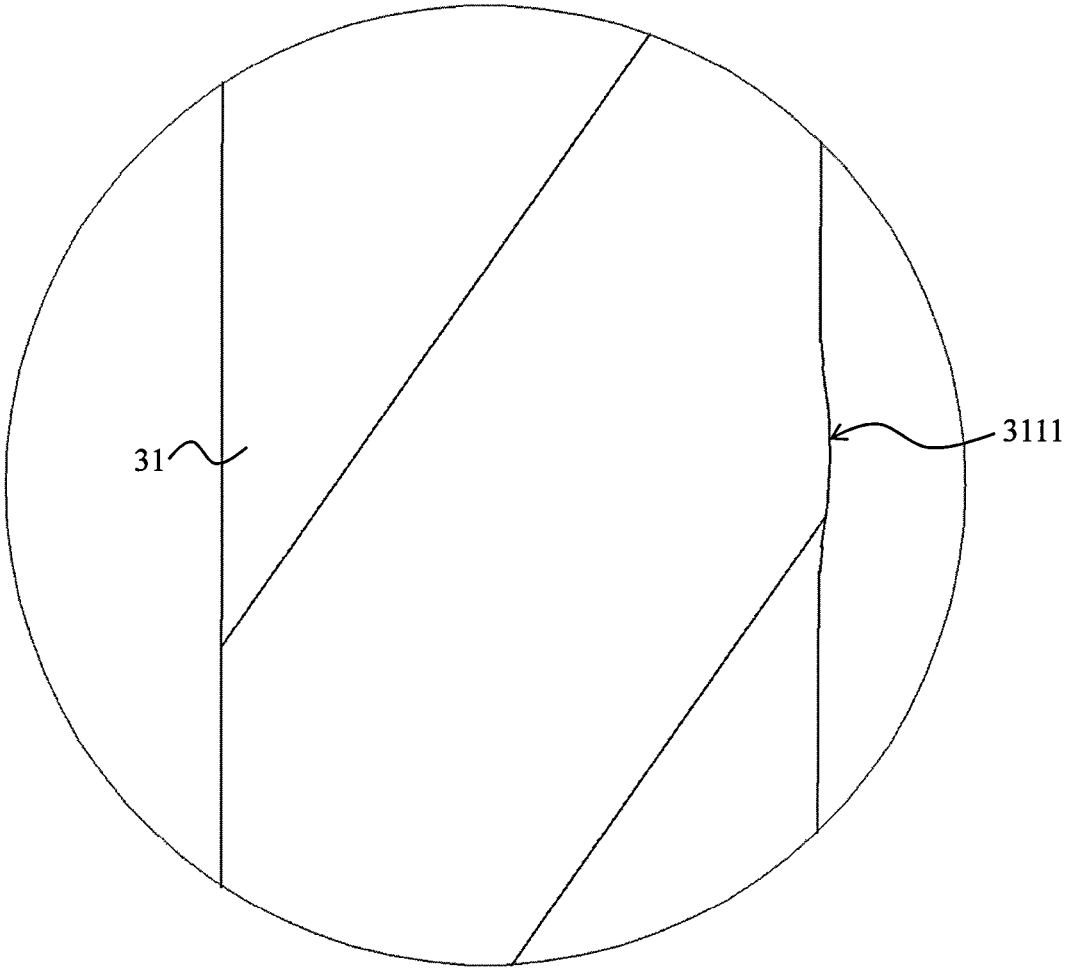
FIG. 8 is a schematic partially enlarged diagram of an area C shown in FIG. 7.
Figure 9:
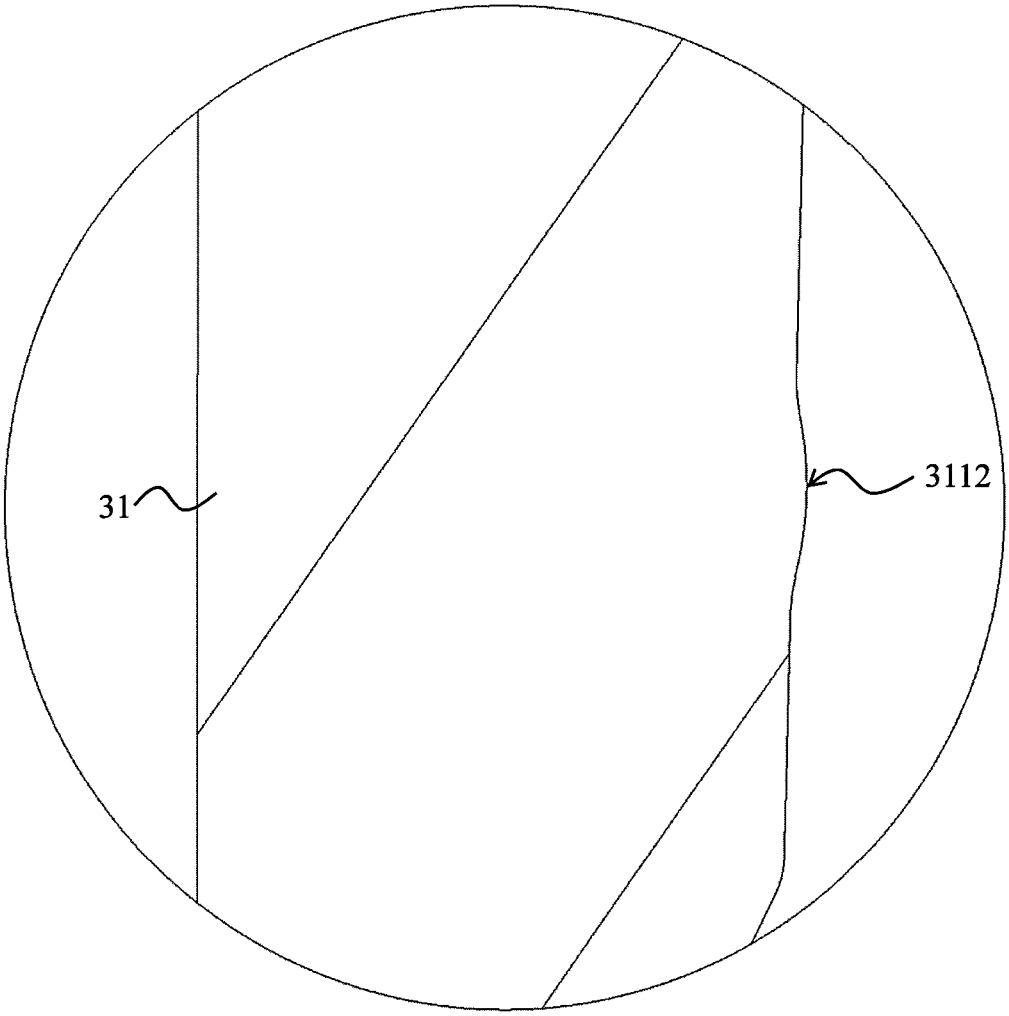
FIG. 9 is a schematic partially enlarged diagram of an area D shown in FIG. 7.

In some embodiments, with reference to FIG. 4 and FIG. 7, the radial inner surface 311 of the sleeve 30 extends obliquely outward from top to bottom, and correspondingly, the radial outer surface of the driving member 40 facing the sleeve 30 extends obliquely outward from top to bottom. In other words, the radial inner surface 311 of the sleeve 30 extends from top to bottom in a direction gradually away from its axis, and correspondingly, the radial outer surface of the driving member 40 facing the sleeve 30 extends from top to bottom in a direction gradually away from its axis. It is easy to understand that when the radial inner surface 311 of the sleeve 30 is provided with the annular flange, difficulty of inserting the driving member 40 into the radial inner side of the sleeve 30 increases when the driving member 40 is assembled with the sleeve 30. According to the embodiments of the application, the radial inner surface 311 of the sleeve 30 is configured to extend obliquely outward from top to bottom, and correspondingly, the radial outer surface of the driving member 40 facing the sleeve 30 is configured to extend obliquely outward from top to bottom, which is beneficial to insert the driving member 40 into the radial inner side of the sleeve 30.

In some embodiments, the radial inner surface 311 of the sleeve 30 and the radial outer surface of the driving member 40 facing the sleeve 30 may be conical surfaces. On one hand, it is beneficial to ensure that the gap between the radial inner surface 311 of the sleeve 30 and the radial outer surface of the driving member 40 facing the sleeve 30 in the axial direction is the same. On the one hand, it facilitates inserting the driving member 40 into the radial inner side of the sleeve 30. For example, an angle between generatrix of the conical surface and height of the conical surface may be 1°-2°.

In some embodiments, with reference to FIG. 3, the driving member 40 is provided with an internal channel 400, and a radial inner wall of the internal channel 400 is provided with a spiral guide groove 401 extending in the axial direction.

Figure 10:
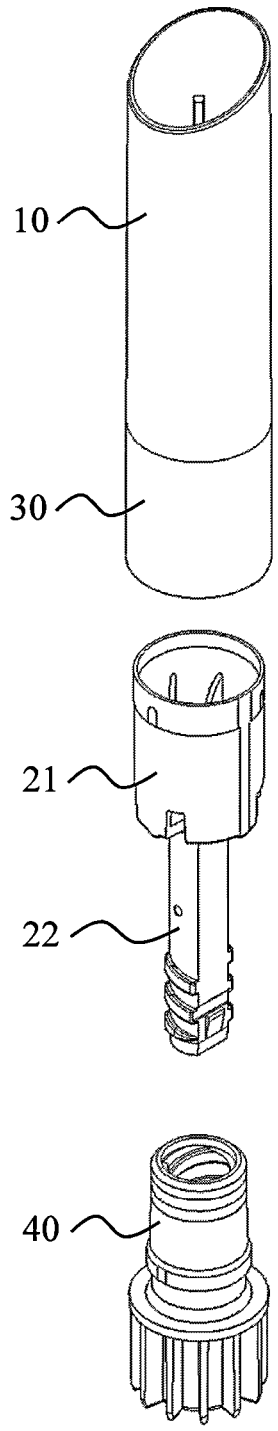
FIG. 10 is a schematic exploded view of the mechanism core shown in FIG. 1.
Figure 11:
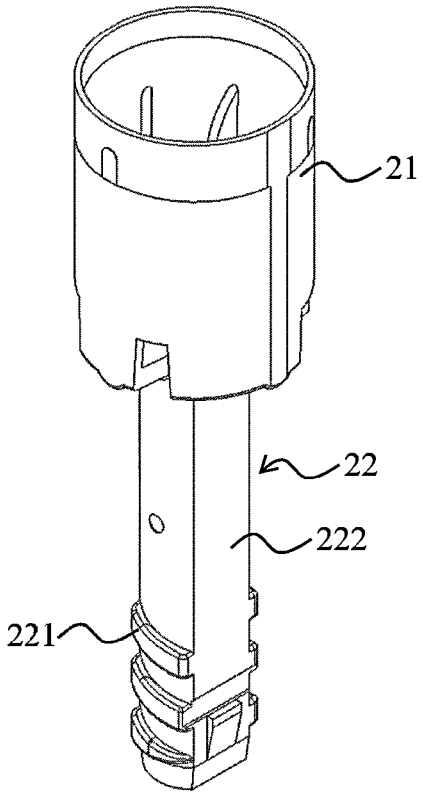
FIG. 11 is a schematic structural diagram of a cup-shaped member and a rod of the mechanism core shown in FIG. 10.

With reference to FIG. 10 and FIG. 11, the mechanism core may further include a rod 22 extending downward from bottom of the cup-shaped member 21 into the internal channel 400 of the driving member 40, at least a part of the rod 22 is provided with an external thread 221 adapted to the spiral guide groove 401. When the sleeve 30 rotates relative to the driving member 40, the rod 22 may drive the cup-shaped member 21 to move in the axial direction, through thread cooperation of the external thread 221 and the spiral guide groove 401.

Figure 12:
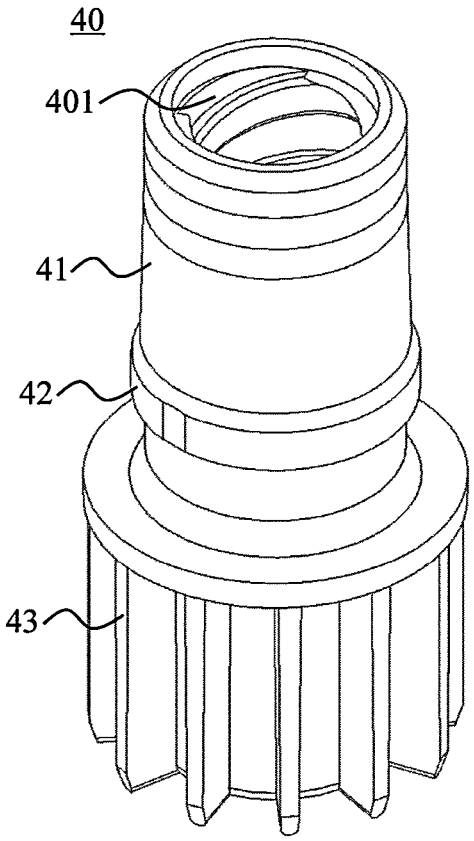
FIG. 12 is a schematic structural diagram of a driving member of the mechanism core shown in FIG. 10.

With reference to FIG. 12, the driving member 40 includes a driving body 41, and the sleeve 30 is sleeved on an upper part of the driving body 41, that is, the upper part of the driving body 41 extends into the sleeve 30. Multiple rib plates 43 are provided at a lower part of the driving body 41, to increase a friction force between it and a base 50 mentioned below.

In some embodiments, multiple turns of external threads 221 are provided on the rod 22, to reduce shaking of the cup-shaped member 21. The cup-shaped member 21 may be integrally formed with the rod 22, and they may be formed into one piece together.

In some embodiments, the rod 22 is hollow at interior thereof. It is easy to understand that after the driving member 40 is inserted into the radial inner side of the sleeve 30, the annular flange may not only "expand" the sleeve 30 in the radial direction, but also make the driving member 40 deform inward in the radial direction. Since the internal channel 400 of the driving member 40 also needs to thread-cooperate with the rod 22, when the rod 22 is hollow at the interior thereof, it is also easy for the rod 22 to deform, to thread-cooperate with the spiral guide groove 401 of the driving member 40 better, and prevent the rod 22 from being clamped after the driving member 40 deforms inward in the radial direction.

With reference to FIG. 2, the rod 22 is formed with a channel 223 penetrating it in the axial direction, at the interior thereof; that is, an end of the channel 223 may extend to communicate with interior of the cup-shaped member 21, and another end of the channel 223 may communicate with the internal channel 400 of the driving member 40. Since the channel 223 penetrates it in the axial direction, it is more beneficial for the rod 22 to generate corresponding deformation, to adapt to deformation of the internal channel 400 of the driving member 40.

With reference to FIG. 11, in some embodiments, a circumferential surface of rod 22 forms at least one cut surface 222. With reference to FIG. 7, the sleeve 30 includes a body 31 and a cover plate 33 formed at top of the body. The cover plate 33 is provided with a channel for the rod 22 to pass through, and the channel forms at least one cut surface, so that the sleeve 30 may drive the rod 22 to rotate relative to the driving member 40 through cooperation of the cut surface 222 of the rod 22 and the cut surface of the channel. That is, when the sleeve 30 rotates relative to the driving member 40, the rod 22 may follow the sleeve 30 to rotate together due to cooperation between the cut surface 222 of the rod 22 and the cut surface of the channel, thereby driving the external thread 221 of the rod 22 to rotate in the spiral guide groove 401 of the driving member 40, and make the cup-shaped member 21 move up and down in the axial direction.

With reference to FIG. 12, an annular limiting groove 32 is formed on the radial inner surface 311 of the sleeve 30, an annular limiting protrusion 42 is formed on the radial outer surface of the driving member 40, and axial positioning of the sleeve 30 and the driving member 40 is achieved through cooperation of the annular limiting groove 32 and the annular limiting protrusion 42, to prevent the sleeve 30 from separating from the driving member 40.

Each annular flange is closer to the cup-shaped member 21 than the annular limiting groove 32. In other words, the radial inner surface 311 of the body 31 is recessed inward to form the annular limiting groove 32, the annular limiting groove 32 may be formed at bottom of the radial inner surface 311, and each annular flange is formed between the annular limiting groove 32 and the cover plate 33.

The mechanism core further includes a bushing 10 extending around the cup-shaped member 21 in the axial direction and connected to the sleeve 30, and the cup-shaped member 21 is movable inside the bushing 10 in the axial direction when the sleeve 30 rotates relative to the driving member 40. Specifically, when the rod 22 follows the sleeve 30 to rotate together in a first direction, the cup-shaped member 21 moves inside the bushing 10 in the axial direction, from a retracted position where the rod-shaped material is located inside the bushing 10 to an extended position where the rod-shaped material may be used; and when the rod 22 follows the sleeve 30 to rotate together in a second direction opposite to the first direction, the cup-shaped member 21 moves inside the bushing 10 in the axial direction, from the extended position to the retracted position.

It is easy to understand that since height of the rod-shaped material is usually higher than that of the cup-shaped member 21, when the cup-shaped member 21 shakes in the radial direction, the rod-shaped material may come into contact with the bushing 10, resulting in damage to the rod-shaped material. In some embodiments of the application, a bottom end of the driving member 40 may be closed, so that when the driving member 40 is prepared by using an injection molding process, an injection gate may be provided at the bottom end of the driving member 40, so that the prepared driving member 40 has a more uniform outer diameter, which reduces shaking of the cup-shaped member 21 in the radial direction, and thus prevents the rod-shaped material from coming into contact with the bushing 10.

In some embodiments, the bushing 10 and the sleeve 30 form an integrally molded member. The bushing 10 and the sleeve 30 may be injection molded from plastics.

In some embodiments, the bushing 10 and the sleeve 30 are separate members, and the bushing 10 is connected to the sleeve 30 by plugging-in. The bushing 10 may be mounted on the sleeve 30, and rotate together with the sleeve 30. Due to production requirements and in order to facilitate demoulding, an axial inner diameter of the bushing 10 made of plastics is non-uniform and needs to be small at an end and large at another end. The non-uniform axial inner diameter of the bushing 10 causes a gap between the bushing 10 and the cup-shaped member 21 to be non-uniform. Therefore, in some embodiments of the application, the bushing 10 is specifically made of metal material. Processes of preparing the metal bushing 10 may make the axial inner diameter of the bushing 10 uniform, thereby making the gap between the bushing 10 and the cup-shaped member 21 uniform, which may further reduce the gap between the bushing 10 and the cup-shaped member 21, and further reduce shaking of the cup-shaped member 21 in the radial direction. Therefore, in some embodiments, the inner diameter of the bushing 10 is uniform in the axial direction. In some embodiments, the metal material may be aluminum, aluminum alloy, or stainless steel, etc.

In some embodiments, the driving member 40 has an up-down penetrated structure. When the rod 22 rotates in the spiral guide groove 401 of the driving member 40 through its external thread 221, a lower end of the rod 22 may extend downward out of the driving member 40. In such embodiments, during the injection molding process of the driving member 40, the injection gate position may be selected to be on a radial side wall of the driving member 40 only, resulting in a non-uniform radius of the driving member 40 in a circumferential direction (that is, a cross section of the driving member 40 is not circular). When the driving member 40 with a non-circular cross section is assembled with other components, a problem of non-uniform size matching is easy to occur, resulting in large gaps in some positions and small gaps in other positions, and finally causing the cup-shaped member 21 to shake significantly in the radial direction.

In some embodiments, the driving member 40 may be configured so that its bottom end is closed. It is easy to understand that the bottom end of the driving member 40 is closed, which means that only a top end surface of the driving member 40 is provided with an opening, and a bottom end surface of the driving member 40 is not provided with an opening, that is, the driving member 40 is not penetrated in the axial direction. A bottom end of the rod 22 cannot extend downward out of the driving member 40, instead, may only move up and down in the axial direction inside the driving member 40. When the driving member 40 is prepared by using the injection molding process, the injection gate may be provided at the bottom end of the driving member 40, so that radius of the prepared driving member 40 in the circumferential direction is more uniform (that is, the driving member 40 has a better roundness), which is beneficial to make the gap between the driving member 40 and the sleeve 30 more uniform, thereby reducing shaking of the cup-shaped member 21, and is also beneficial to improve feel when the driving member 40 rotates relative to the sleeve 30.

In some embodiments, the driving member 40 may be molded by using a core mold, so as not to form a mold closing line on the radial outer surface, thereby ensuring roundness of the driving member 40.

Figure 13:
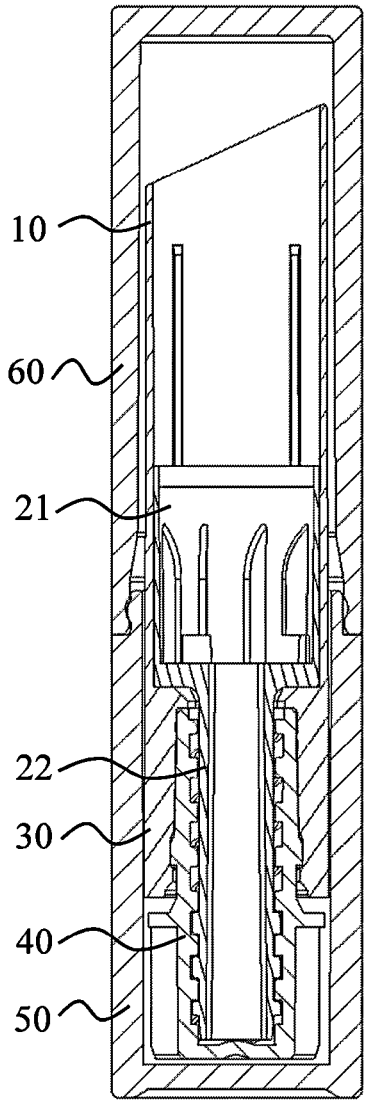
FIG. 13 is a schematic cross-sectional view of a packaging tube according to an embodiment of the application.

Based on the mechanism core of any one of the above embodiments, an embodiment of the application also provides a packaging tube. With reference to FIG. 13, the packaging tube of the embodiment of the application may include a base 50, a mechanism core, and a top cover 60. The mechanism core may be the mechanism core of any one of the embodiments of the application. The mechanism core may be arranged on the base 50. The top cover 60 is configured to form, with the base 50, a cavity surrounding the mechanism core. The base 50 may form a receiving cavity with an opening, and the opening of the receiving cavity faces the top cover 60. The driving member 40 is inserted into the receiving cavity, to mount the mechanism core on the base 50. The bushing 10 extends upward to protrude out of the base 50. When the packaging tube is used, the bushing 10 may be rotated relative to the base 50, to rotate the rod-shaped material out of the bushing 10 or rotate the rod-shaped material into the bushing 10.

With regard to the embodiments of the application, it should also be noted that the embodiments of the application and features in the embodiments may be combined with each other without conflict, to obtain new embodiments.

The above descriptions are only preferred embodiments of the application, and are not intended to limit the application. The application may have various modifications and variations for those skilled in the art. Any modification, equivalent replacement, improvement, or the like made within the spirit and principle of the application should be included in the scope of protection of the application.

The invention claimed is:

1. A mechanism core, comprising:

a cup-shaped member, configured to accommodate rod-shaped material;

a driving member; and a sleeve, sleeved on the driving member and rotatable relative to the driving member, and the cup-shaped member movable in an axial direction when the sleeve rotates relative to the driving member, wherein at least one annular flange is formed on a radial inner surface of the sleeve, and the at least one annular flange is configured to contact a radial outer surface of the driving member facing the sleeve, so that the at least one annular flange is slidable relative to the radial outer surface of the driving member during rotation of the sleeve relative to the driving member, wherein lubricating oil is filled between the radial inner surface of the sleeve and the radial outer surface of the driving member facing the sleeve, and wherein there are two annular flanges in number, and the two annular flanges are formed on the radial inner surface of the sleeve at an interval in the axial direction, to seal the lubricating oil between the two annular flanges.

2. The mechanism core of claim 1, wherein a surface of the annular flange facing the driving member is a smoothly-transitioned curved surface which is high at center and low at two ends.

3. The mechanism core of claim 1, wherein the radial inner surface of the sleeve extends obliquely outward from top to bottom, and correspondingly, the radial outer surface of the driving member facing the sleeve extends obliquely outward from top to bottom.

4. The mechanism core of claim 1, wherein the driving member is provided with an internal channel, and a radial inner wall of the internal channel is provided with a spiral guide groove extending in the axial direction, the mechanism core further comprises a rod extending downward from bottom of the cup-shaped member into the internal channel of the driving member, at least a part of the rod is provided with an external thread adapted to the spiral guide groove.

5. The mechanism core of claim 4, wherein the rod is hollow at interior thereof.

6. The mechanism core of claim 1, further comprising:

a bushing, extending around the cup-shaped member in the axial direction and connected to the sleeve, and the cup-shaped member movable inside the bushing in the axial direction when the sleeve rotates relative to the driving member, the bushing and the sleeve forming an integrally molded member, or the bushing connected to the sleeve by plugging-in.

7. The mechanism core of claim 1, wherein an annular limiting groove is formed on the radial inner surface of the sleeve, an annular limiting protrusion is formed on the radial outer surface of the driving member, and axial positioning of the sleeve and the driving member is achieved through cooperation of the annular limiting groove and the annular limiting protrusion, wherein the at least one annular flange is closer to the cup-shaped member than the annular limiting groove.

8. A packaging tube, comprising:

a base;

the mechanism core of claim 1, arranged on the base; and a cover, configured to form, with the base, a cavity surrounding the mechanism core.

* * * * *